United States Patent [19]

Hain

[11] Patent Number: 4,699,374

[45] Date of Patent: Oct. 13, 1987

[54] SHEET FEEDING APPARATUS

[75] Inventor: David A. Hain, Monifieth, Scotland

[73] Assignee: NCR Corporation, Dayton, Ohio

[21] Appl. No.: 931,291

[22] Filed: Nov. 17, 1986

[30] Foreign Application Priority Data

Aug. 5, 1986 [GB] United Kingdom ..... 8619067

[51] Int. Cl.[4] ..... B65H 5/10

[52] U.S. Cl. ..... 271/267; 271/95; 271/115; 271/116; 271/275; 271/314

[58] Field of Search ..... 271/267, 268, 269, 84, 271/95, 107, 115, 116, 275, 315, 314

[56] References Cited

U.S. PATENT DOCUMENTS

| | | | |
|---|---|---|---|
| 3,941,375 | 3/1976 | La White | 271/275 |
| 4,429,866 | 2/1984 | Castro-Hahn | 271/267 |
| 4,544,149 | 10/1985 | Graef et al. | 271/107 |
| 4,623,081 | 11/1986 | Hain et al. | 225/105 |

FOREIGN PATENT DOCUMENTS 2059394 4/1981 United Kingdom .

2145399 3/1985 United Kingdom .

*Primary Examiner*—Richard A. Schacher

*Attorney, Agent, or Firm*—Wilbert Hawk, Jr.; Albert L. Sessler, Jr.

[57] ABSTRACT

A sheet feeding apparatus is arranged to feed sheets, such as bank statements, along a guideway (40) to an exit slot (16), the guideway (40) including a smooth guide surface (58) which has the configuration of part of a cylinder. Two elastomeric rolls (108) are rotatably mounted on a support (80) mounted on a drive shaft (64) whose axis lies along the center of curvature of said guide surface (58). During a sheet feeding operation, the support (80) is rotated from a position in which the rolls (108) are adjacent an entry throat (54) of the guideway (40) to a position in which the rolls (108) are adjacent the exit slot (16), the rolls (108) pressing a sheet (24') against said guide surface (58) and causing the sheet to be slidably moved along said guide surface. During this movement, gears (94, 100, 102, 104) carried by the support (80) bring about rotation of said rolls in such a direction as to increase the sheet feeding movement.

12 Claims, 8 Drawing Figures

SHEET FEEDING APPARATUS

BACKGROUND OF THE INVENTION

This invention relates to a sheet feeding apparatus. The invention has application, for example, to a self-service financial terminal or automated teller machine (ATM) including a feeding mechanism arranged to deliver a statement or receipt to an exit port for collection by a bank customer.

In U.K. patent application No. 2145399A, for example, there is disclosed an automated teller machine which can be used in well-known manner to dispense currency notes to a user of the machine, in response to the user inserting a customer identifying card into the machine and entering certain data upon one or more keyboards associated with the machine, and which as part of a cash dispensing transaction delivers a receipt slip to a receipt outlet slot for collection by the user. The receipt slip is produced by printing on the leading portion of a continuous form and then separating this portion from the remainder of the form, following which the receipt slip is delivered to the receipt outlet slot by a sheet feeding mechanism. The sheet feeding mechanism includes rotating roller means which grip and apply tension to the continuous form during the printing and separating operations, and which assist in feeding the separated receipt slip to the receipt outlet port.

Problems have been experienced with known sheet feeding mechanisms, such as that referred to above, in which rotating roller means engage a sheet while the sheet is held against movement, in that there is a tendency for the roller means to generate static electricity which may have an adverse effect on associated electronic components. Another problem experienced with known sheet feeding mechanisms in which a printing operation is carried out on a sheet while it is engaged by rotating roller means is that lines of printing on the sheet may be distorted due to the pulling effect on the sheet. A further problem experienced with known sheet feeding mechanisms is that, if the length of the sheets to be fed by a sheet feeding mechanism is changed, it may be difficult to modify the mechanism so that sheets are fed in a correct manner to an associated outlet, particularly in the case of sheets of short length.

SUMMARY OF THE INVENTION

According to the invention there is provided a sheet feeding apparatus comprising sheet guide means along which sheets are arranged to be fed one by one in operation to an exit port, said guide means including a smooth first guide surface which has the configuration of part of a cylinder and which extends from a first end portion of said guide means remote from said exit port to a second end portion of said guide means adjacent said exit port; support means mounted on a drive shaft whose axis lies substantially along the center of the curvature of said guide surface; elastomeric roll means rotatably mounted on an end of said support means remote from said drive shaft; positioning means for holding a sheet to be fed to said exit port in a stationary position in which said sheet extends within said first end portion of said guide means; drive means for bringing about a reciprocal rotation of said drive shaft whereby said support means is caused to be rotated in a reciprocal manner between a first position and a second position, rotation of said support means from said first position to said second position serving to cause said roll means to press a sheet held by said positioning means against said guide surface and cause this sheet to be slidably moved along said guide surface to said exit port; and means for permitting rotation of said roll means on said support means in a first predetermined direction only which corresponds to the direction of rotation of said support means when rotating from said first position to said second position.

It is accordingly an object of the present invention to provide sheet feeding apparatus which minimizes the generation of static electricity.

Another object is to provide sheet feeding apparatus in which lines of printing on a.sheet being fed are not distorted due to a pulling effect on the sheet.

Another object is to provide sheet feeding apparatus in which sheets of varying length are fed correctly to an associated outlet.

With these and other objects, which will become apparent from the following description, in view, the invention includes certain novel features of construction and combinations of parts, a plurality of forms or embodiments of which are hereinafter described with reference to the drawings which accompany and form a part of this specification.

DESCRIPTION OF THE PREFERRED EMBODIMENTS

Figure 1:
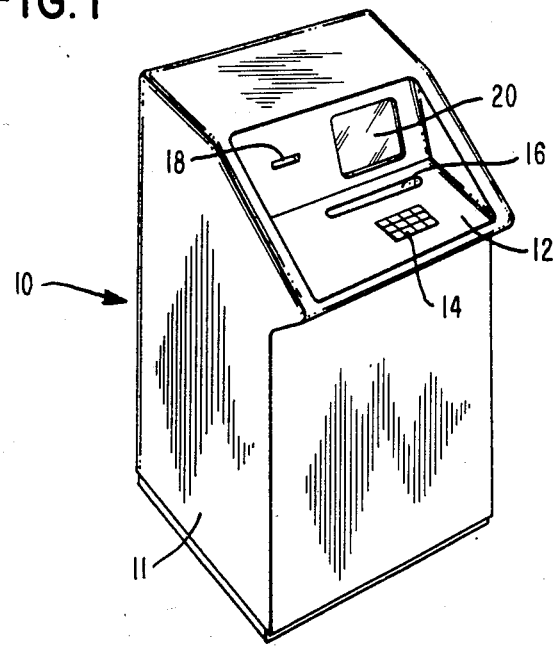
FIG. 1 is a perspective view of a self service financial terminal arranged to print and issue account statements to bank customers.
Figure 2:
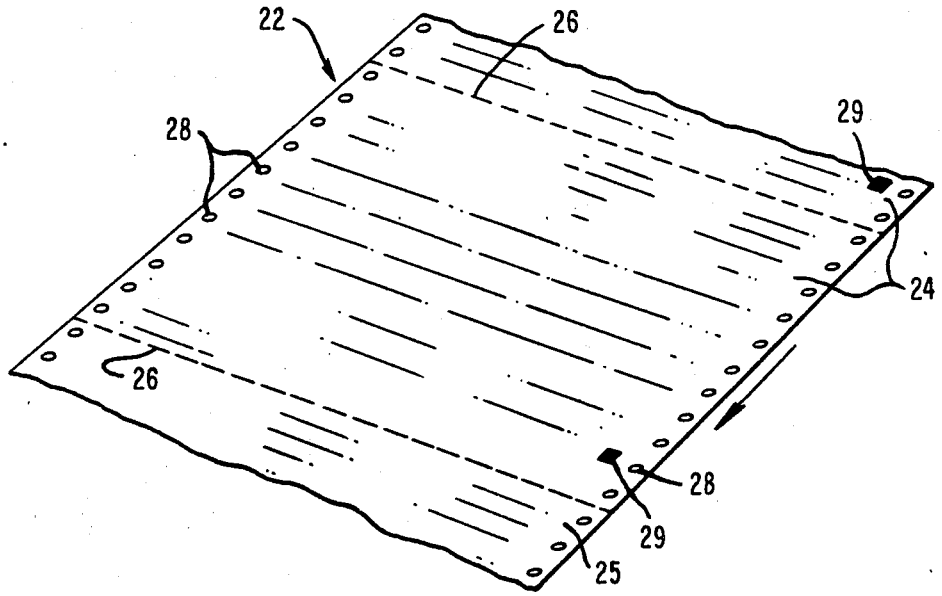
FIG. 2 is a perspective view of a portion of a continuous form used in the terminal of FIG. 1.

Referring to FIG. 1 of the drawings, the self-service financial terminal 10 shown therein is intended to be free standing in the lobby of a bank and is arranged to provide printed account statements on request to bank customers. The terminal 10 includes a housing 11 in an upper fascia portion 12 of which are provided a keyboard 14, a statement exit slot 16, a card entry slot 18 and a display screen 20. In operation, a user inserts a customer identifying card into the slot 18 and then enters certain data such as his personal identification number upon the keyboard 14. Instructions to the user for operating the terminal are displayed on the screen 20. In response to the data entered by the user, the terminal prints account information on the leading portion of a continuous form 22 (FIG. 2) utilized in the terminal.

The continuous form 22 is separable into individual sheets (corresponding to successive portions 24 of the form 22) by bursting the form along transverse weakened lines 26 such as lines of perforations. The form 22 is provided with equispaced sprocket holes 28 adjacent each edge, by means of which the form 22 can be moved in the direction indicated by the arrow. Also, each portion 24 carries a mark 29 (hereinafter referred to as a stop mark) adjacent its leading end, the purpose of which will be described later. In response to data entered by a user on the keyboard 14, the terminal prints account information on the leading portion or sheet 24 of the form 22, then separates this sheet from the remainder of the form 22 by bursting the form 22 along the leading weakened line 26, and feeds the separated sheet to the user through the slot 16.

Figure 3:
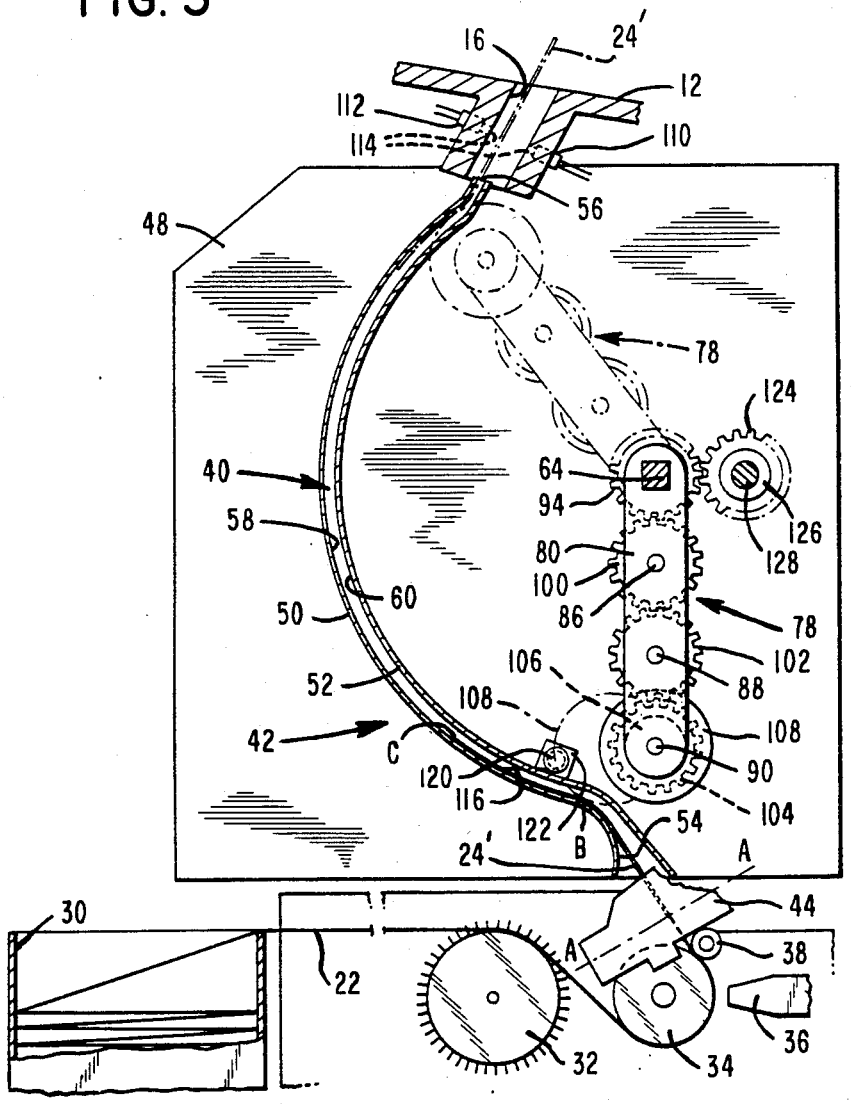
FIG. 3 is a part sectional side elevational view of a sheet feeding mechanism used in the financial terminal of FIG. 1 together with an associated continuous form supply and feeding mechanism, the section being taken along the line 3—3 of FIG. 4.

Referring now to FIG. 3, the continuous form 22 is fed from a storage container 30 by a pair of sprocket wheels 32 which engage the sprocket holes 28 of the form 22, the form being stored in fan-folded manner in the container 30. Downstream of the sprocket wheels 32, the form 22 passes partly around a cylindrical platen 34 which, together with a print head schematically indicated at 36, forms part of the printing mechanism of the terminal. The continuous form 22 is held against the surface of the platen 34 by a guide roller 38. In the course of a bursting operation, the leading end of the form 22 is fed into one end of an elongated guideway 40 forming part of a sheet feeding mechanism 42. Between the platen 34 and guideway 40, the form 22 extends through a burster apparatus schematically indicated at 44. The burster apparatus 44 is arranged to separate the first portion or sheet 24' of the form 22 from the remainder of the form 22 by bursting the form along a burst line A—A, which passes through the leading weakened line 26 of the form 22. As will be described in detail hereafter, the separated sheet 24' (account statement) is fed along the guideway 40 to the exit slot 16 formed in the fascia portion 12 where the sheet 24' can be collected by the user of the terminal.

The sheet feeding mechanism 42 will now be described with reference to FIGS. 3 to 6. The mechanism 42 includes a support frame having parallel vertical side plates 46 and 48, the guideway 40 being supported between the side plates 46 and 48. The guideway 40 includes a curved outer guide member 50 and a curved inner guide member 52, each of which are constructed of an electrically conductive sheet material such as steel. The lower ends of the guide members 50 and 52 define between them an entry throat 54, and the upper ends of the guide members 50 and 52 define between them an exit opening 56. Between the entry throat 54 and the exit opening 56, the guide member 50 has a smooth inner guide surface 58 having the configuration of a part of a cylinder and the guide 52 has a smooth outer guide surface 60 also having the configuration of a part of a cylinder, the surfaces 58 and 60 having a common center of curvature. Four elongated, parallel slots 62 (FIG. 4) are formed in the inner guide member 52, the slots 62 extending for substantially the whole length of the surface 60.

A drive shaft 64 having a square cross-section extends between, and passes through, the side plates 46 and 48. The shaft 64 is rotatably supported by suitable bearings 66 mounted on the side plates 46 and 48, the axis of the shaft 64 lying along the center of curvature of the guide surfaces 58 and 60. That part of the shaft 64 which extends beyond the side plate 46 is provided with a drive gear 68 connected by means (not shown) to an electric motor 70 (FIG. 7); the motor 70 is arranged to drive the shaft 64 in a reversible manner as will be described later. A timing disc 72 (see also FIG. 6) is mounted on that part of the drive shaft 64 extending beyond the side plate 48, a peripheral portion of the disc 72 passing between a light source 74 and a photosensor device 76 mounted on the side plate 48. In the present embodiment, the light source 74 is a light emitting diode (LED).

Figure 4:
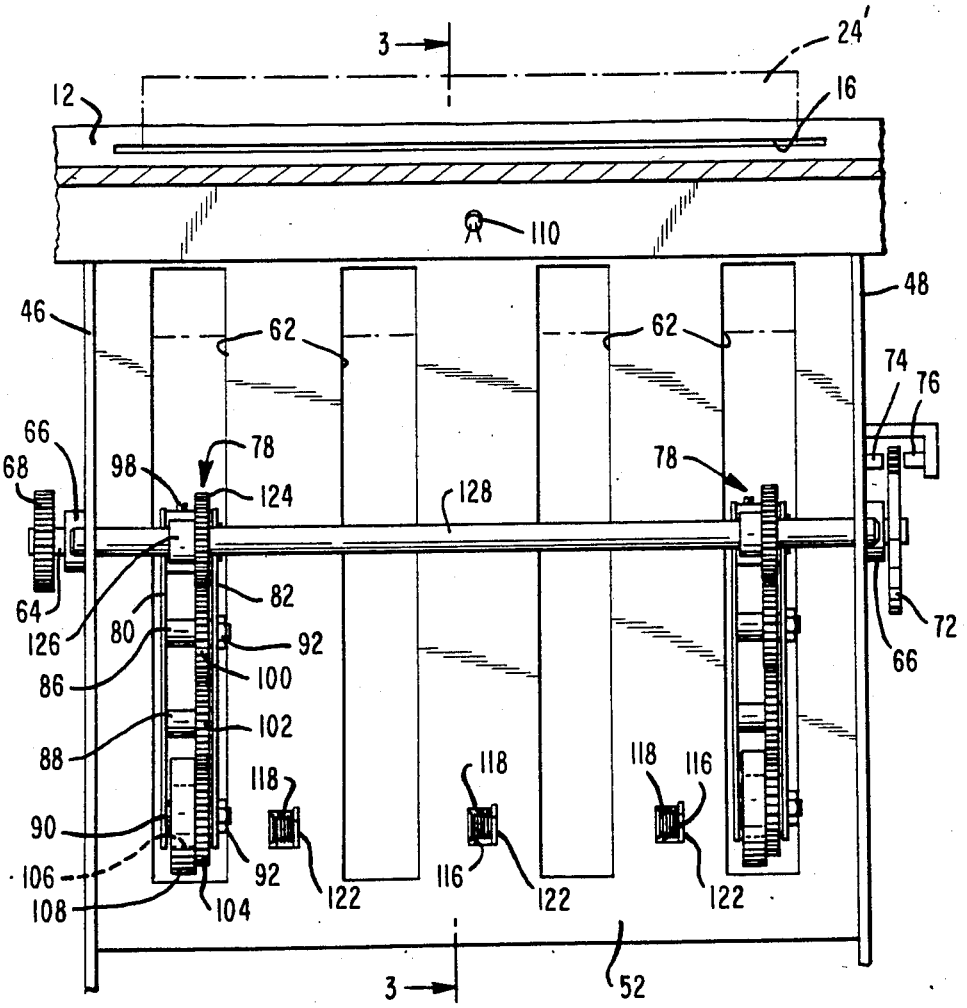
FIG. 4 is a front elevational view of the sheet feeding mechanism shown in FIG. 3.
Figure 5:
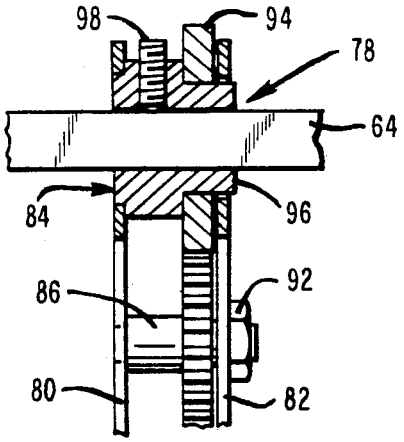
FIG. 5 is an enlarged sectional view of part of an arm assembly of the sheet feeding mechanism.

Two arm assemblies 78 are mounted on the drive shaft 64 for rotation therewith, the shaft 64 passing through a portion of each assembly 78 adjacent one end thereof. In the arrangement shown in FIG. 4, the arm assemblies 78 are respectively aligned with the two end slots of the four slots 62 formed in the inner guide member 52. However, as will be explained later, the positions of the arm assemblies 78 along the shaft 64 can be adjusted so that the assemblies can be aligned with other ones of the slots 62. Each arm assembly 78 includes a pair of side arms 80, 82. The side arms 80, 82 are spaced apart by means of a hub 84 (FIG. 5) secured to the side arm 80 and by means of three studs 86, 88, 90 secured to the side arm 80. The arms 80, 82 are held together by means of nuts 92 which threadably engage with portions of the studs 86 and 90 which project beyond the side arm 82. Referring particularly to FIG. 5, a gear wheel 94 is rotatably mounted on a portion 96 of reduced diameter of the hub 84, the gear wheel 94 being positioned adjacent the inner face of the side arm 82. A retaining screw 98 which passes through the hub 84 serves to retain the respective arm assembly 78 in its desired location on the drive shaft 64, and also permits the arm assembly 78 to be moved to a different location along the shaft 64.

The gear wheel 94 of each arm assembly 78 engages with a gear wheel 100 which is rotatably mounted on the stud 86 and which forms part of a gear train (best seen in FIG. 3) including further gear wheels 102 and 104, the gear wheel 100 being interposed between the gear wheels 94 and 102, and the gear wheel 102 being interposed between the gear wheels 100 and 104. The gear wheel 102 is rotatably mounted on the stud 88, and the gear wheel 104 is mounted on a roller clutch 106 which in turn is mounted on the stud 90. A roll 108 of elastomeric material is mounted on the stud 90 of each arm assembly 78 and is secured to the respective gear wheel 104 for rotation therewith, the roll 108 being of greater diameter than the gear wheel 104. The construction of each roller clutch 106 is such that rotation of the respective roll 108 on the stud 90 is permitted in a clockwise direction only with reference to FIG. 3.

The periphery of the elastomeric roll 108 of each arm assembly 78 projects beyond the ends of the respective side arms 80, 82 remote from the shaft 64. The distance between the axis of the shaft 64 and the point on the periphery of each roll 108 furthest from this axis is slightly greater than the radius of curvature of the guide surface 58. Thus, with reference to FIG. 3, rotation of each arm assembly 78 in a clockwise direction from the position shown in solid outline will cause the periphery of the respective roll 108 to pass through the associated slot 62 in the inner guide member 52 and come into cooperative relationship with the surface 58 of the outer guide member 50 at a position B. Thereafter, during continued rotation of the arm assemblies 78 in a clockwise direction, the rolls 108 move over the surface 58 in cooperative relationship therewith until this rotation is stopped in a manner to be explained later. At the completion of such clockwise rotation, each arm assembly 78 is in a position, as indicated in chain outline in FIG. 3, in which the associated roll 108 is adjacent the exit opening 56.

As will be described in more detail later, the clockwise rotational movement of the arm assemblies 78 just referred to serves to feed the separated sheet 24' from the position shown in solid outline in FIG. 3 to the position shown in chain outline in which the leading edge of the sheet 24' projects above the upper fascia portion 12. An LED 110 and a photosensor 112 are mounted in cooperative relationship in openings 114 formed in the fascia portion 12, and are arranged to detect the leading edge of the sheet 24' as it passes through the exit slot 16.

Three spring fingers 116 are arranged to lightly engage the sheet 24' when it is in the position indicated in solid outline in FIG. 3, in which position a leading portion of the sheet 24' extends within a lower portion of the guideway 40. The fingers 116 respectively extend through openings 118 formed in the inner guide member 52. The openings 118 are positioned between the slots 62 as shown in FIG. 4, with each pair of adjacent slots 62 having an opening 118 centrally positioned therebetween. Each spring finger 116 is mounted on a respective stud 120 secured to a bracket 122 extending from the concave surface of the guide member 52.

Two further gear wheels 124 are respectively mounted on two roller clutches 126 which are in turn mounted on a fixed rod 128 which extends between, and is secured to, the side plates 46 and 48. The roller clutches 126 are adjustably positioned on the rod 128 so that the gear wheels 124 respectively engage with the gear wheels 94. The construction of the roller clutches 126 is such that rotation of the gear wheels 124 on the rod 128 is permitted in a clockwise direction only with reference to FIG. 3.

Figure 6:
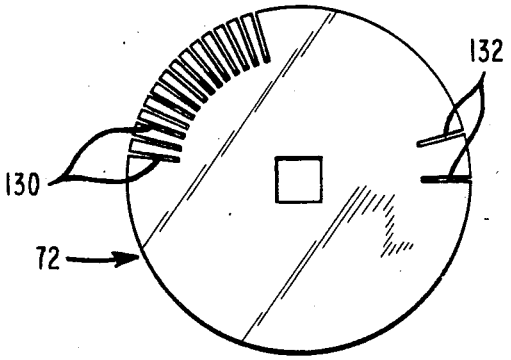
FIG. 6 is an enlarged side elevational view of a timing disc used in the sheet feeding mechanism.
Figure 7:
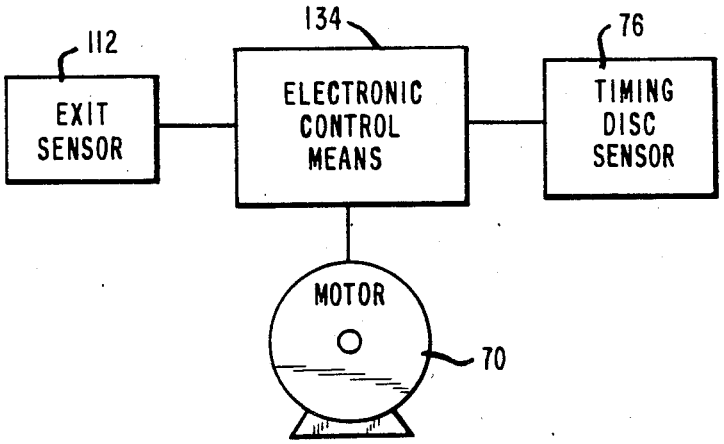
FIG. 7 is a schematic block diagram illustrating the electrical interconnections of parts of the sheet feeding mechanism.

Referring now to FIG. 6, the timing disc 72 is provided with a series of closely spaced slots 130 extending radially inwards from the periphery of the disc 72, and is provided with two further slots 132, spaced more widely apart than are the slots 130, also extending radially inwards from the periphery of the disc 72. The slots 130 and 132 are sensed by the photosensor 76 in cooperation with the LED 74 during rotation of the drive shaft 64.

The financial terminal 10 includes electronic control means 134 (FIG. 7) which is connected to the motor 70 and to the timing disc sensor 76 and the exit sensor 112. In conjunction with the sensing of the leading edge of the sheet 24' by the sensor 112, the sensing of the slots 130 by the sensor 76 serves to enable the electronic control means 134 to determine the point at which rotation of the arm assemblies 78 in a clockwise direction (with reference to FIG. 3) by the motor 70 is stopped. When the sheet 24' is removed from the exit slot 16 by the user of the financial terminal 10, the sensing of the trailing edge of the sheet 24' by the sensor 112 brings about energization of the motor 70 in the opposite sense under the control of the electronic control means 134 so as to initiate a rotation of the arm assemblies 78 in a counterclockwise direction (with reference to FIG. 3). The sensing of the slots 132 by the sensor 76 serves to determine the point at which the counterclockwise rotation of the arm assemblies 78 is stopped.

The operation of the sheet feeding mechanism 42 and associated parts of the financial terminal 10 will now be described. Immediately prior to a user requesting a statement from the terminal 10, the arm assemblies 78 are in a rest (non-operated) condition as shown in solid outline in FIG. 3, and the sprocket wheels 32 and platen 34 are stationary, the leading edge of the form 22 being positioned at the burst line A—A. Upon the user initiating a statement printing operation by inserting his customer identifying card in the slot 18 and entering appropriate data upon the keyboard 14, the sprocket wheels 32 and the platen 34 are operated to drive the form 22 past the print head 36 (FIG. 3), the print head 36 being arranged to print account information on the leading portion or sheet 24 of the form 22. As the form 22 is fed past the print head 36, the leading portion 24 passes burster apparatus 44, and the leading edge of the form 22 is guided into the throat 54 of the guideway 40. After the print head 36 has completed its printing operation, the leading portion 24 of the form 22 continues to be fed through the burster apparatus 44 and along the guideway 40, and the leading edge of the form 22 eventually passes beneath the ends of the spring fingers 116. This feeding movement of the form 22 continues until a sensing device (not shown) included in the burster apparatus 44 senses the stop mark 29 carried by the next succeeding portion 24 of the form 22. Thereupon, movement of the form 22 is stopped, the stationary sprocket wheels 32 acting as a brake on the form 22. The stop marks 29 on the form 22 are so positioned that the form 22 is stopped with the leading weakened line 26 positioned at the burst line A—A. Next, the burster apparatus 44 is operated so as to burst the form 22 along the leading weakened line 26, thereby separating the leading sheet 24' from the remainder of the form 22. At this point, the major part of the sheet 24' is located inside the guideway 40 with its leading edge located at position C in FIG. 3. It should be understood that immediately following the separation of the sheet 24' from the remainder of the form 22 the sheet 24' is held in a position partly inside the guideway 40 by virtue of the spring fingers 116 lightly pressing the sheet 24' against the guide surface 58.

Following the bursting of the form 22 along the line A—A, the electronic control means 134 energizes the motor 70 in such a sense as to drive the shaft 64 in a clockwise direction with reference to FIG. 3 and thereby cause the arm assemblies 78 to rotate in a clockwise direction. (It should be understood that in the subsequent description any mention of clockwise direction or counterclockwise direction is to be taken as being with reference to FIG. 3). As previously mentioned, each gear wheel 124 is prevented by the respective roller clutch 126 from rotating in a counterclockwise direction, so that the associated gear wheel 94, which is in engagement with the gear wheel 124, is prevented from rotating in a clockwise direction. Accordingly, as the arm assemblies 78 rotate in a clockwise direction, the gear wheels 100 rotate about the studs 86 in a clockwise direction by virtue of being in engagement with the gear wheels 94 which are held stationary by the gear wheels 124. This clockwise rotation of each gear wheel 100 brings about a counterclockwise rotation of the associated gear wheel 102 which in turn brings about a clockwise rotation of the associated gear wheel 104 and elastomeric roll 108. Shortly after the commencement of the rotation of the arm assemblies 78 in a clockwise direction, the elastomeric rolls 108 come into frictional engagement with the sheet 24' at position B in FIG. 3, and continued rotation of the arm assemblies 78 causes the sheet 24' to be pushed by the rolls 108 along the guideway 40 towards the exit opening 56. It should be understood that, during this feeding movement of the sheet 24', the rolls 108 are slightly compressed and thereby press the sheet 24' against the smooth guide surface 58 of the outer guide member 50. It should be further understood that since the rolls 108 are rotating in a clockwise direction about the studs 90 during the clockwise rotation of the arm assemblies 78, a more rapid, and therefore greater, feeding movement of the sheet 24' is brought about than would have been the case if each roll 108 were secured to the associated side arms 80 and 82 without the capability of rotation relative thereto.

Towards the end of the feeding movement of the sheet 24', the leading edge of the sheet 24' enters the exit slot 16 and is sensed by the sensor 112 in cooperation with the LED 110. Following the sensing of this leading edge by the sensor 112, the electronic control means 134 counts a predetermined number of slots 130 sensed by the timing disc sensor 76 and when this predetermined count is reached the motor 70 is de-energized and the arm assemblies 78 are stopped in the position shown in chain outline in FIG. 3. At this time, the sheet 24' is held by the rolls 108 in the position shown in chain outline in FIG. 3 with its leading edge projecting above the fascia portion 12, the sheet 24' in this position being available for collection by the user of the terminal 10. As previously mentioned, when the user removes the sheet 24' from the exit slot 16, the sensor 112 senses the trailing edge of the sheet 24', whereupon the electronic control means 134 causes the electric motor 70 to be energized in a reverse sense so as to bring about a rotation of the arm assemblies 78 in a counterclockwise direction towards their home positions.

During this counterclockwise rotation of the arm assemblies 78, the rolls 108 roll over the guide surface 58 without any slippage occurring between the rolls 108 and the surface 58, with the gear wheels 94 rotating in a counterclockwise direction about the axis of the drive shaft 64. Counterclockwise rotation of the arm assemblies 78 continues until the two slots 132 in the timing disc 72 are sensed by the sensor 76, whereupon the electronic control means 134 causes the motor 70 to be de-energized and the arm assemblies 78 are stopped in their home positions as shown in solid outline in FIG. 3. The financial terminal 10 is now ready to provide a further printed statement when requested to do so by a user of the terminal.

The clockwise rotation of the rolls 108 about the studs 90 during a clockwise rotation of the arm assemblies 78 is of importance, since this rotation of the rolls 108 enables the sheet feeding mechanism 42 to correctly feed a short sheet whose leading edge might not otherwise project above the fascia portion 12 when the arm assemblies 78 have completed their maximum extent of rotation away from their home positions. Moreover, the sheet feeding mechanism 42 has the advantage of versatility in that it can be readily modified to feed relatively long sheets. Thus, the sheet feeding mechanism 42 could be modified by removing the gear wheels 124, in which case no rotation of the rolls 108 about the studs 90 would take place during a clockwise rotation of the arm assemblies 78, since the gear wheels 94 would be free to rotate together with the drive shaft 64 and the roller clutches 106 would prevent counterclockwise rotation of the rolls 108 while the rolls 108 are in frictional engagement with the separated sheet 24'. As a result, the extent of feeding movement of the sheet 24' would simply be determined by the extent of angular rotation of the arm assemblies 78, which in the embodiment hereinbefore described is approximately 145°. Another aspect of the versatility of the sheet feeding mechanism 42 is that it can be readily adjusted for use with relatively narrow sheets. Thus, although in the arrangement shown in FIG. 4 the two arm assemblies 78 are respectively aligned with the two outer slots of the four slots 62 formed in the inner guide 52, the position of one or each of the arm assemblies 78 on the drive shaft 64 could be adjusted so that the arm assembly is aligned with the next one of the slots 62, the appropriate adjustment depending on the width of the sheets to be fed. It should be understood that any adjustment of the position of an arm assembly 78 on the drive shaft 64 would be accompanied by a corresponding adjustment of the position of the associated gear wheel 124 on the rod 128.

Further advantages of the sheet feeding mechanism 42 hereinbefore described are that the mechanism is compact and is of simple construction, and there is no tendency for a sheet to be pulled during a printing operation. Moreover, wear of the rolls 108 is kept to a minimum since there is no slipping movement between the rolls 108 and the guide surface 58, and the generation of static electricity in operation is substantially avoided by virtue of the fact that the guide member 58 is of electrically conductive material and there is no slipping movement between a sheet and the rolls 108 after the rolls 108 come into engagement with the sheet.

Figure 8:
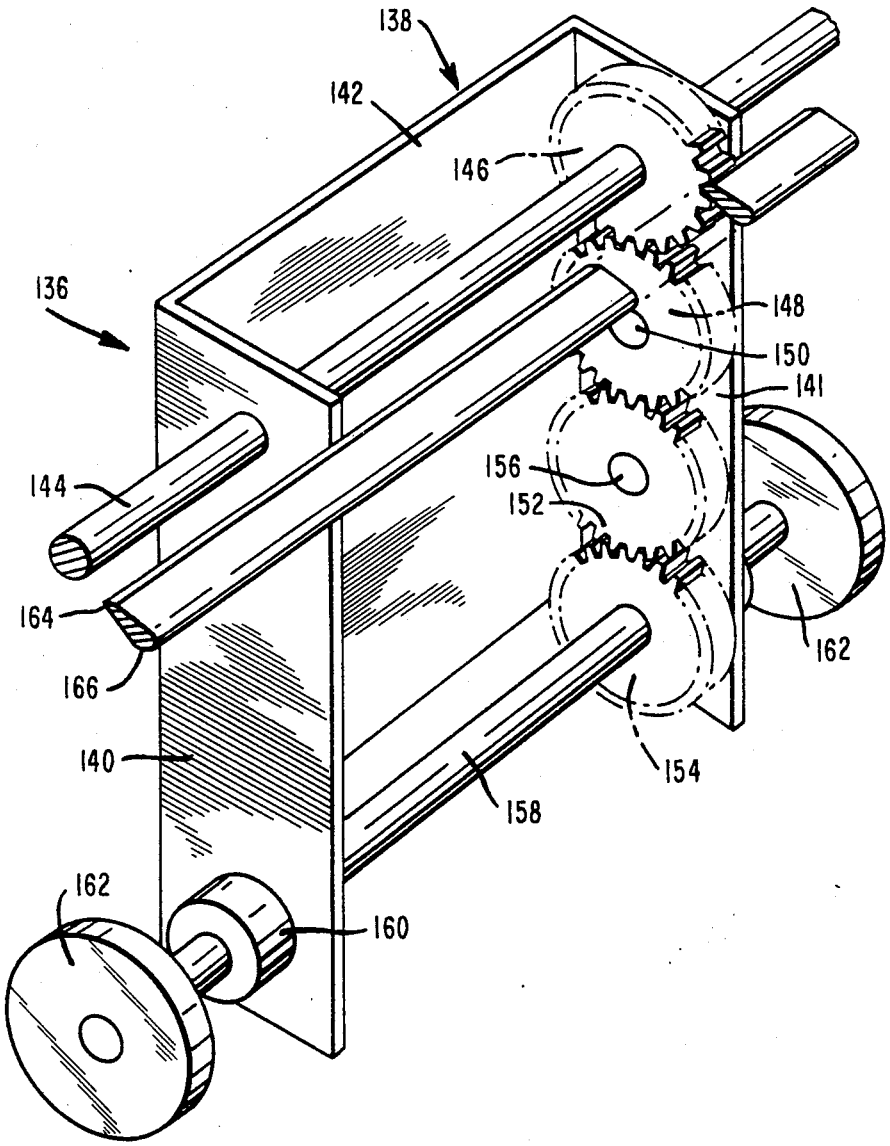
FIG. 8 is a schematic perspective view of a single arm assembly which may be used in place of the two arm assemblies of the sheet feeding mechanism of FIG. 2.

Referring now to FIG. 8, there is shown therein a single arm assembly 136 which may be used in place of the two arm assemblies 78 shown in FIGS. 3 to 5. The arm assembly 136 includes a support frame 138 comprising two side arms 140, 141 and a transverse portion 142 integral with the side arms 140, 141. The support frame 138 is secured to a shaft 144 of circular cross-section which replaces the shaft 64 shown in FIGS. 3 to 5, the shaft 144 extending between, and being rotatably mounted with respect to, the side plates 46 and 48. A gear wheel 146 is rotatably mounted on the shaft 144 and is positioned adjacent the inner face of the side arm 141. The gear wheel 146 engages with a gear wheel 148 which is rotatably mounted on a stud 150 secured to the side arm 141 and which forms part of a gear train including further gear wheels 152 and 154, the gear wheel 148 being interposed between the gear wheels 146 and 152, and the gear wheel 152 being interposed between the gear wheels 148 and 154. The gear wheel 152 is rotatably mounted on a stud 156 secured to the side arm 141, and the gear wheel 154 is mounted on a shaft 158 for rotation therewith. The shaft 158 passes through the side arms 140, 141 and through a roller clutch 160 mounted on the side arm 140. The construction of the roller clutch 160 is such that rotation of the shaft 158 relative to the support frame 138 is permitted in a clockwise direction only with reference to FIG. 8. Two rolls 162 of elastomeric material are secured to the ends of the shaft 158 extending beyond the side arms 140, 141. The rolls 162 correspond to the rolls 108 shown in FIGS. 3 and 4, and are positioned so that they are respectively in alignment with two of the slots 62 in the inner guide member 52. A bail 164 secured to a shaft 166 engages with the gear wheel 146, the shaft 166 extending between, and being rotatably mounted with respect to, the side plates 46, 48. The shaft 166 is urged in a counterclockwise direction with reference to FIG. 8 by spring means (not shown) so as to maintain the bail 164 in engagement with the gear wheel 146. It should be understood that the bail 164 serves as a replacement for the gear wheel 124 and roller clutch 126 shown in FIGS. 3 and 4, the bail 164 acting in the manner of a pawl to prevent rotation of the gear wheel 146 in a clockwise direction (with reference to FIG. 8) about the shaft 144. If desired, the rolls 162 could be adjustably positioned on the shaft 158, and the support frame 138 and shaft 158 could be so dimensioned as to enable the rolls 162 to be aligned with different ones of the slots 62 in the inner guide member 52.

What is claimed is:

1. Sheet feeding apparatus comprising:

sheet guide means along which sheets are arranged to be fed one by one in operation to an exit port, said guide means including a smooth first guide surface which has the configuration of part of a cylinder and which extends from a first end portion of said guide means remote from said exit port to a second end portion of said guide means adjacent said exit port;

support means mounted on a drive shaft whose axis lies substantially along the center of curvature of said guide surface;

elastomeric roll means rotatably mounted on an end of said support means remote from said drive shaft;

positioning means for holding a sheet to be fed to said exit port in a stationary position in which said sheet extends within said first end portion of said guide means;

drive means for bringing about a reciprocal rotation of said drive shaft whereby said support means is caused to be rotated in a reciprocal manner between a first position and a second position, rotation of said support means from said first position to said second position serving to cause said roll means to press a sheet held by said positioning means against said guide surface and cause this sheet to be slidably moved along said guide surface to said exit port; and means for permitting rotation of said roll means on said support means in a first predetermined direction only which corresponds to the direction of rotation of said support means when rotating from said first position to said second position.

2. The sheet feeding apparatus of claim 1, also including means for bringing about rotation of said roll means on said support means during a rotation of said support means from said first position to said second position.

3. The sheet feeding apparatus of claim 1, wherein said means for bringing about rotation of said roll means includes first gear means mounted on said drive shaft, control means for permitting rotation of said first gear means in a second direction only, said second direction being opposite to said first direction, and second gear means mounted on said support means in cooperative relationship with said first gear means and said roller means whereby, during a rotation of said support means from said first position to said second position, rotation of said roll means on said support means is brought about in consequence of rotation of said first gear means being prevented.

4. The sheet feeding apparatus of claim 3, wherein said control means includes third gear means mounted in cooperative relationship with said first gear means, and means for permitting rotation of said third gear means in said first direction only.

5. The sheet feeding apparatus of claim 1, also including roller clutch means mounted on said support means and arranged to permit rotation of said roll means on said support means in said first direction only.

6. The sheet feeding apparatus of claim 1, wherein first guide surface is of electrically conductive material.

7. The sheet feeding apparatus of claim 1, wherein said guide means includes a second guide surface spaced from, and extending parallel to, said first guide surface, said second guide surface being disposed between said first guide surface and said shaft, and said roll means being arranged to project through slot means in said second guide surface during the feeding of a sheet to said exit slot.

8. The sheet feeding apparatus of claim 1, wherein said support means includes a first arm assembly and a second arm assembly, corresponding ends of which are secured to and spaced apart along, said shaft, and wherein said roll means includes first and second rolls respectively mounted on the ends of said first and second arm assemblies remote from said shaft.

9. The sheet feeding apparatus of claim 8, wherein the spacing apart of said first and second arm assemblies on said shaft is adjustable.

10. The sheet feeding apparatus of claim 1, wherein said positioning means includes resilient finger means mounted in cooperative relationship with said first guide surface and arranged to press a sheet extending within said first end portion of said guide means against said first guide surface.

11. The sheet feeding apparatus of claim 1, wherein said support means comprises a single assembly which includes a central portion connected to two end portions which are mounted on said shaft, and wherein said roll means includes first and second rolls respectively mounted adjacent to the ends remote from said shaft of the end portions of said assembly.

12. The sheet feeding apparatus of claim 3, wherein said control means includes bail means mounted in cooperative relationship with said first gear means and operable to permit rotation of said first gear means in said second direction only.

* * * * *